United States Patent [19]

Lance

[11] Patent Number: 4,562,626

[45] Date of Patent: Jan. 7, 1986

[54] SNAP FASTENER AND METHOD OF ATTACHING SAME

[75] Inventor: Mark A. Lance, Pascoe Vale, Australia

[73] Assignee: W. A. Deutsher Proprietary Limited, Moorabbin, Australia

[21] Appl. No.: 534,903

[22] Filed: Sep. 22, 1983

[30] Foreign Application Priority Data

Nov. 23, 1982 [AU] Australia ..... PF6931

[51] Int. Cl.[4] ..... A44B 17/00

[52] U.S. Cl. ..... 24/689; 24/662; 24/674; 24/679; 24/687

[58] Field of Search ..... 24/662, 671, 687, 688, 24/689, 679, 674

[56] References Cited

U.S. PATENT DOCUMENTS

| | | | |
|---|---|---|---|
| 1,559,279 | 10/1925 | Pierce | 24/689 |
| 2,071,505 | 2/1937 | Dews | 24/689 |
| 2,081,400 | 5/1937 | Jones | 24/671 |
| 2,807,069 | 9/1957 | Jansson | 24/674 |
| 3,195,201 | 7/1965 | Ash, II | 24/689 |
| 3,355,780 | 12/1967 | Daddona, Jr. | 24/689 |
| 3,538,557 | 11/1970 | Hirose | 24/679 |
| 3,685,105 | 8/1972 | Carlile et al. | 24/689 |
| 3,869,766 | 3/1975 | Raymond | 24/662 |
| 3,975,803 | 8/1976 | Katayama | 24/689 |

FOREIGN PATENT DOCUMENTS

| | | | |
|---|---|---|---|
| 800977 | 7/1936 | France | 24/687 |

*Primary Examiner*—Victor N. Sakran

*Attorney, Agent, or Firm*—Trexler, Bushnell & Wolters Ltd.

[57] ABSTRACT

A snap fastener and method of attaching the same to a section of sheet material are disclosed. The snap fastener comprises an operative component and a securing component, both of these components being formed of plastics material. The operative component has a base wall with an opening therethrough and a tubular portion including a snap engaging portion formed thereon surrounds the opening and projects from one side of the base wall. The securing component has a pin and a cap flange at one end thereof, the pin being adapted to pass through the opening of the operative component so that the terminal end portion of the pin is located beyond the side of the base wall from which the tubular portion projects. The terminal end portion of the pin is deformable when so located relative to the operative component so as to secure the two components against separation. At least a peripheral portion of the cap flange slopes outwardly in a direction towards the terminal end of the pin. The method of attaching the fastener to a section of sheet material includes the steps of causing the pin to pierce the sheet material, locating the operative component over the pin so that the sheet material is interposed between the cap flange and the base wall and the pin projects through the opening so that the terminal end portion thereof projects beyond the base wall. Thereafter, pressure is applied to the terminal end of the pin to deform same to an extent such that the pin cannot be withdrawn out of the opening. Axial pressure is additionally applied to both of the components to press them together and thereby reduce or remove by deformation the slope of the cap flange, this axial pressure also being maintained during the deformation of the pin terminal end.

10 Claims, 11 Drawing Figures

SNAP FASTENER AND METHOD OF ATTACHING SAME

This invention relates to snap fasteners of the kind used to releasably secure two pieces of sheet material together. The fastener of the invention is particularly suited for use with textile materials and the like and consequently may be used as a clothing fastener, but it has other uses and is adaptable to other materials. It will be convenient however, to describe the invention with particular reference to textiles and the like.

Snap fasteners are commonly made from metal and are of relatively complex construction. Also, they are generally constructed in a manner such that it is not a simple operation to attach them to the base or supporting sheet material. For example, it is usual to require a preformed hole in each piece of sheet material to which the fastener parts are to be attach- ed.

It is an object of the present invention to provide a snap fastener of relatively simple construction which can be easily attached to the base sheet material. It is a further object of the invention to provide such a fastener which can be made of plastics material. Still another object of the invention is to provide an improved method for attaching a snap fastener component to the base or carrier sheet material.

According to one aspect of the present invention, there is provided a snap fastener part including, an operative component and a securing component, both said components being formed of plastics material, said operative component having a base wall with an opening therethrough and a tubular portion surrounding said opening and projecting from one side of said base wall, snap engaging means provided on said tubular portion, said securing component having a pin and a cap flange at one end thereof, said pin being adapted to pass through said opening so that a terminal end portion thereof is located beyond said one side of the base wall, and said terminal end portion is deformable when so located to secure the two said components against separation.

According to another aspect of the invention, there is provided a method of attaching a snap fastener part to a section of sheet material wherein the snap fastener part is as described above, said method including the steps of, causing said pin to pierce said sheet material, locating said operative component over said pin so that said sheet material is interposed between said cap flange and said base wall and said pin projects through said opening so that the terminal end portion thereof projects beyond said one side of the base wall, and applying pressure to the terminal end of said pin to deform same to an extent such that said pin cannot be withdrawn out of said opening.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) is not to be understood as limiting on the invention.

In the drawings

FIG. 1 a part sectioned side elevational view of two components of a female fastener part according to one embodiment of the FIG. 2 is a view similar to FIG. 1 but showing the two components of the male fastener part;

Figure 1:
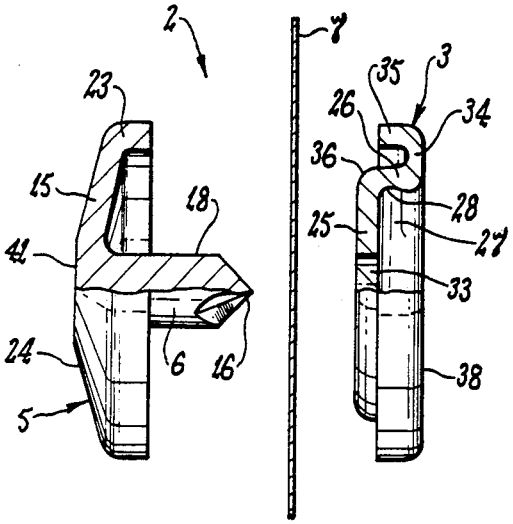
Figure 2:
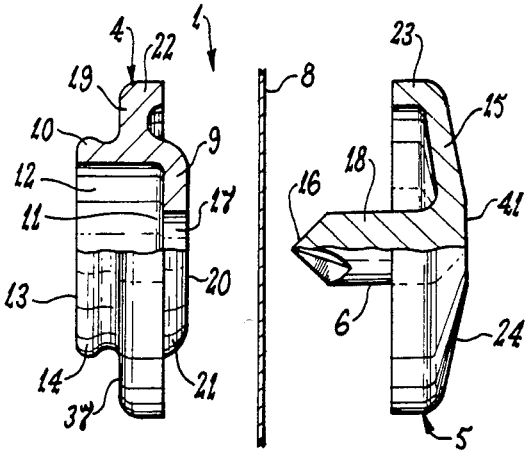
Figure 2:
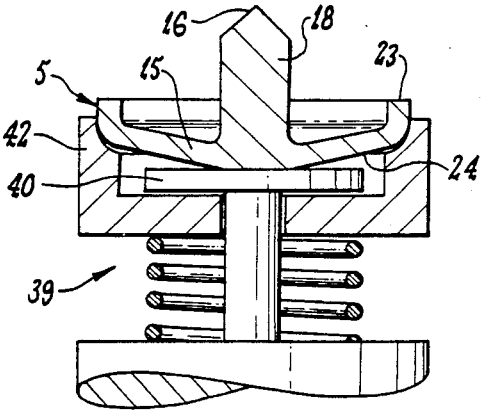

As with conventional fasteners, a fastener according to the invention comprises a male part 1 (FIG. 2) and a female part 2 (FIG. 1). Each part 1 and 2 is made up of two components, an operative component 3 or 4 and a securing component 5. In the preferred form shown, the securing component 5 is of the same form for each part 1 and 2 thereby simplifying manufacture and assembly with attendant saving in cost. It is further preferred, as also shown, that the securing component 5 includes a pin 6 which is able to pierce sheet material 7 or 8 without the need for a preformed hole and which is adapted to be deformed to secure the two components 3 or 4 and 5 of the fastener part 1 or 2 together.

The fastener according to the invention is ideally suited for manufacture by moulding or a similar process and can be made of a suitable plastics material such as acetal. Plastic fasteners have the advantage of being resistant to corrosive environments and can be easily coloured to suit requirements. In addition, they have low heat conductivity and electrical insulating properties which make them particularly suited for some conditions of use. It will be convenient to hereinafter describe such a moulded plastic embodiment of the fastener.

In the particular form of the fastener shown, the operative component 4 of the male part 1 has a base wall 9 of circular shape and tubular portion in the form of a hollow cylndrical stud 10 projecting axially from one side 11 of the wall 9. The interior 12 of the stud 10 is open and accessible at the outer end 13 of the stud 10 which is remote from the base wall 9. A circumferential snap engaging bead 14 is formed around the external surface of the stud 10 at the outer end 13 for cooperative engagement with the female fastener part 2 as hereinafter described.

Figure 10:
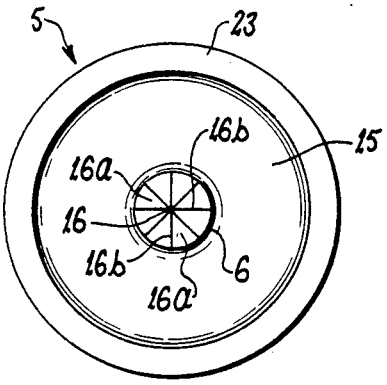
FIG. 10 is an end view of the securing component shown in FIGS. 1 and 2.
Figure 11:
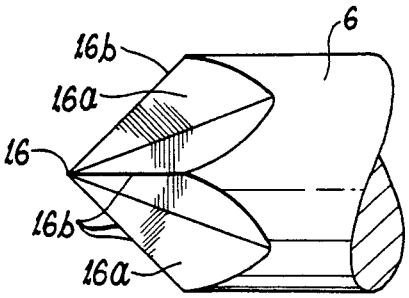
FIG. 11 is an enlarged perspective view of the terminal end of the pin of the component shown in FIG. 10.

The securing component 5 includes a pin 6 and a cap flange 15, which may be circular, at one end of the pin 6. It is preferred, as shown, that the terminal end 16 of the pin 6 is pointed or otherwise formed so that it can pierce textiles and similar materials thereby avoiding the need for a preformed hole to enable attachment of the fastener components to such material. In the construction particularly shown, the pointed or conical terminal end 16 is provided with a plurality of grooves or flutes **16*a* which form edges 16*b* extending longitudinally of the pin 6. The grooves 16*a* and the edges 16*b* are best seen in FIGS. 10 and 11, and in the particular example shown there are four grooves 16*a* and four edges 16*b***.

When the fastener described above is being applied to sheet material 7 or 8, the terminal end 16 pierces that material and the edges 16*b* then function to cut the material so as to facilitate continued penetration of the pin 6 through the material. Such an arrangement enables the fastener to be applied to a variety of materials including leather, vinyl, and multi-layer cottons.

Figure 6:
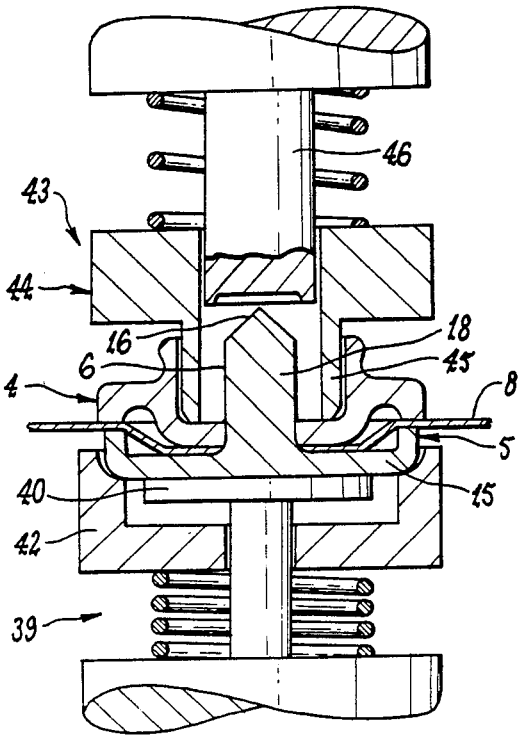
Figure 7:
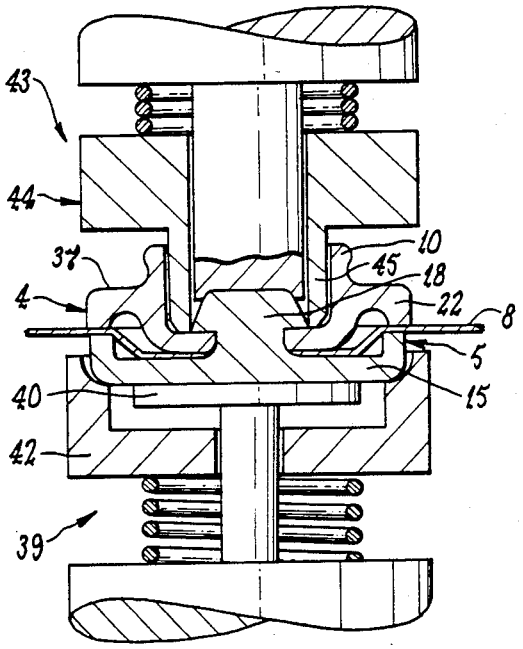
Figure 9:
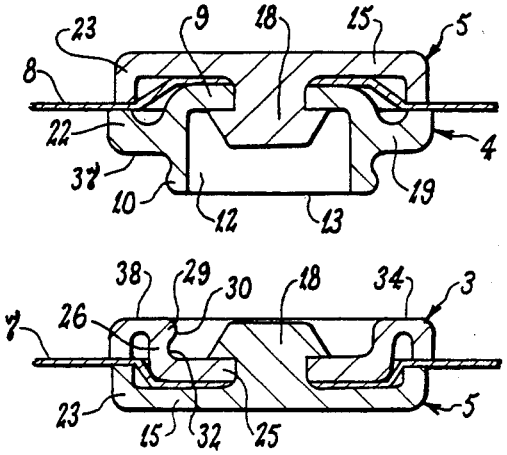
FIG. 9 is a cross sectional view of a snap fastener according to the invention but with the two parts separated.

The pin 6 is projected through a sheet of material 8 so that the cap flange 15 bears against one side of that material. The base wall 9 of the male operative component 4 has a central opening 17 for receiving the pin 6 and that wall 9 is placed over the pin 6 and engaged with the opposite side of the sheet material 8 (FIG. 6). In that position, the terminal end portion 18 of the pin 6 projects into the interior of the stud 10 and the two components 4 and 5 can be secured together by deforming that terminal end portion 18 so that it cannot be withdrawn back out through the opening 17 (FIGS. 7 and 9). The sheet material 8 is therby captured between the base wall 9 of the operative component 4 and the cap flange 15 of the securing component 5.

It is preferred that material locking means is provided so as to provide a secure clamping of the sheet material 8 between the two components 4 and 5. In the construction shown, that includes a circuferential flange 19 formed around the body of the operative component 4 at a location spaced axially from the outer surface 20 of the base wall 9 which engages the sheet material 8. The radially outer portion 21 of the surface 20 may curve or slope towards the flange 19 for a reason hereinafter made clear. In the particular construction shown, a short skirt portion 22 is provided around the periphery of the flange 19 and projects towards the base wall surface 20.

The securing component 5 may include another part of the material locking means. In the construction shown, that includes an axially projecting lip 23 provided around the periphery of the cap flange 15 and extending in the direction of the pin 6.

When the two components 4 and 5 are secured together, as shown in FIG. 9, the intervening section of sheet material 8 is clamped between the skirt portion 22 and lip 23 and is forced out of a flat condition by engagement with the surface 20 so as to increase the security of the clamping action. Such an arrangement minimises the possibility of relative movement between the sheet material 8 and the attached fastener part 1 and thereby minimizes possible fatigue failure of the material 8.

It will be apparent that the sheet locking means can take other forms.

The cap flange 15 preferably has some flexibility such as to permit resilient distortion in the engages position. For that purpose, the flange 15 may be of dished configuration so as to have a diaphragm effect to compensate for loss of tension on the sheet material 8 after the pin 6 has been deformed into the securing condition. In the construction shown, the foregoing is achieved by arranging at least the peripheral portion 24 of the flange 15 so that it slopes outwardly and towards the pin end 16. Such an arrangement ensures firm clamping of the sheet material 8 between the two components 4 and 5.

The operative component 3 of the female part 2 may have a base wall 25 as shown and a substantially cylindrical tubular section 26 projecting axially from one side of the wall 25. The tubular section 26 defines an open-mouthed cavity 27 for receiving the stud 10 of the male part 1. As shown in FIG. 1, a circumferential groove 28 may be formed in the surface of the cavity 27 at a location spaced axially inwards of the cavity open mouth so as to cooperate with the stud bead 14. It is preferred however, to use alternative bead engaging means as shown in FIGS. 3 and 4.

Figure 3:
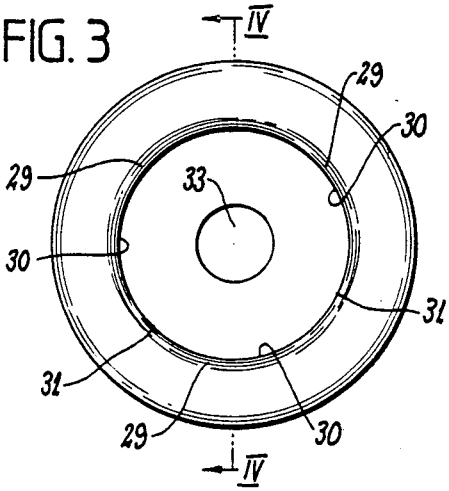
FIG. 3 is a front view of one form of the operative component shown in FIG. 1.
Figure 4:
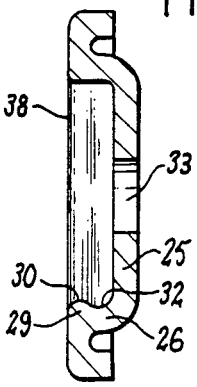
FIG. 4 is a cross sectional view taken along line IV—IV of FIG. 3.

In the construction of FIGS. 3 and 4, a plurality of lip sections 29 is arranged circumferentially around the open mouth of the cavity 27 and provides the means for snap engaging with the bead 14. In the example embodiment shown, there are three lip sections 29, but any other suitable number may be adopted.

Each lip section 29 extends circumferentially of the cavity mouth and preferably has maximum radial inwards projection at a region 30 substantially midway in the circumferential length of the lip section 29. That is, the radial projection of the lip section 29 progressively decreases on each side of the mid region 30 and it may in fact reduce to zero. A space 31 may exist between adjacent ends of adjacent lip sections 29, as shown, or one lip section 29 may continue into another. In the former case, separate groove segments 32 (FIG. 4) will exist beneath respective lip sections 29, whereas in the latter case there may be a continuous groove of varying depth.

An arrangement as described above has the advantage that each lip section 29 can distort to allow insertion and withdrawl of the stud 10. There may be some diametral expansion of the tubular section 26, but it is unlikely to be significant. Also, the use of lip sections 29 makes the fit of the mating fastener components 3 and 4 less critical and thereby aids manufacture of the fastener.

It is preferred that the securing component 5 of the female part 2 is the same as that for the male part 1. The base wall 25 of the operative component 3 therefore has a central opening 33 to receive the pin 6 of the securing component 5. Also, material locking means as previously described is preferably provided on the female part 2. That is, the component 3 is provided with a circumferential flange 34 and skirt portion 35 similar to those of the component 4, and the outer surface 36 of the base wall 25 is located axially beyond the skirt portion 35.

Each fastener part 1 and 2 is secured to its respective portion of sheet material 8 and 7 respectively in the manner previously described. That is, the securing pin 6 is projected through the base wall 9 or 25 of the operative component 4 or 3 respectively, and then deformed or flattened at its terminal end portion 18 to bear against the inner surface of the base wall 9 or 25. In the case of the female fastener part 2, the degree of deformation is preferably such that the deformed portion 18 of the pin 6 is able to fit within the bore 12 of the stud 10.

The stud 10 and the cavity 27 of the female part 2 are of related dimensions such that the stud bead 14 will snap engage behind the lip sections 29. In that condition, the opposed surfaces 37 and 38 of the circumferential flanges 19 and 34 are preferably in face to face engagement. If the fastener parts 1 and 2 are composed of a plastic material, they are able to be engaged and disengaged repeatedly due to the natural resilience of that material. The force needed to engage and disengage the fastener parts 1 and 2 may be reduced by providing one or more radial slots in the male stud 10 and/or the female tubular section 26 so as to make it easier to compress or expand respectively that element.

A fastener as described has the advantage of simplicity of construction and ease of manufacture. In addition, it is a relatively simple operation to secure the fastener to sheet material.

Figure 5:
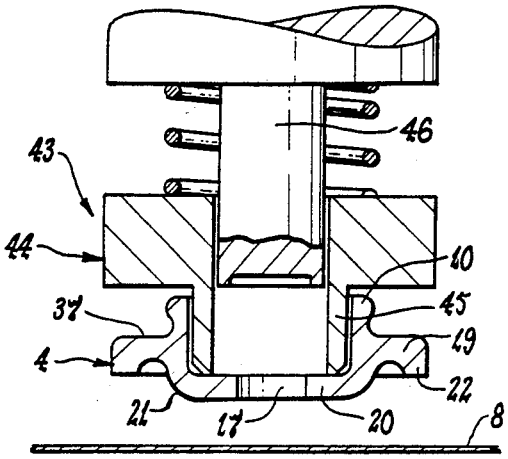
FIGS. 5 to 7 are semi diagrammatic figures showing one method of assembling the components shown in FIG. 2.
Figure 8:
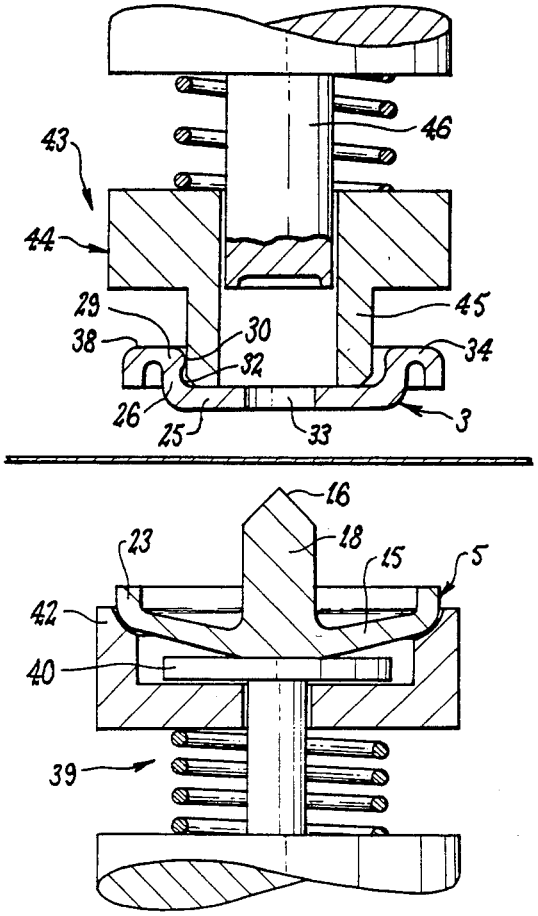
FIG. 8 is a view similar to FIG. 5 but including the components of FIG. 1.

One method of securing the fastener parts 1 and 2 is shown in FIGS. 5 to 8, and in that method the respective securing component 5 of one such part 1 or 2 is placed in the cavity of a fixture 39 so that the pin 6 extends upwards. The fixture 39 may comprise a rigid table section 40 which bears against a central portion 41 of the flange 15 and a spring loaded locating section 42 which defines the perimeter of the fixture cavity and engages against the outer peripheral portion of the flange 15. When the securing component 5 is initially located in the fixture cavity it has the bowed or dished configuration as previously described (FIGS. 5 and 8).

The operative component 4 (FIGS. 5 to 7) or 3 (FIG. 8) is attached to another fixture 43 located above and in alignment with the fixture 39. The fixture 43 may include a springloaded retaining section 44 having a barrel part 45 which fits neatly within the stud bore 12 (FIGS. 5 to 7), or the cavity 27 (FIG. 8), so as to retain the component 4 or 3 by frictional engagement. Because of the different diameters of the bore 12 and cavity 27, a different retaining section 44 will be required for each. The retaining section 44 is slidably located over an anvil section 46 which is operable to engage and deform the securing pin 6 as hereinafter described.

When each component of the fastener part 1 or 2 is located on or retained by its respective fixture 39 or 43 and those fixtures 39 and 43 are axially spaced apart, a section of sheet material 7 or 8 can be located in the space between the fixtures 39 and 43 so as to be generally transverse to the securing pin 6. Movement of one or each fixture 39 and 43 axially towards the other brings the pin 6 into engagement with the sheet material 7 or 8 and subsequently causes the pin 6 to pierce that sheet material 7 or 8. At that time one side of the sheet material 7 or 8 bears against the outer surface 36 or 20 of the operative component base wall 25 or 9 and the pin 6 is projected through the central opening 33 or 17 of that wall 25 or 9. The lip 23 of the flange 15 then engages the opposite side of the sheet material 7 or 8 and causes that sheet to fold across the surface 36 or 21 of the base wall 25 or 9 respectively.

As the foregoing operation progresses, the tension being built-up in the trapped section of sheet material 7 or 8 causes the flange 15 to flatten (FIGS. 6 and 7). That is, the outer edge portion of the flange 15 is moved downwards and that movement is permitted by the spring loading of the locating section 42 of the fixture 39. A stage is also reached (FIG. 6) at which the retaining section 44 of the fixture 43 is prevented from moving further towards the table section 40 of the fixture 39 so the spring loading of that retaining section 44 allows the anvil section 46 to continue its movement towards the securing pin 6. In the final stage of the operation (FIG. 7), the anvil section 46 bears against and laterally deforms the terminal end portion 18 of the pin 6 to secure the two components 5 and 3 or 4 together.

When the fixtures 39 and 43 are moved apart, any relaxation of the clamping effect of the deformed pin 6 is compensated by the bias created in the flange 15. That flange 15 has been flattened from its relaxed and dished condition and consequently maintains pressure against the section of sheet material 7 or 8 trapped between its lip 23 and the skirt portion 35 or 22 of the operative component 3 or 4.

It will be appreciated that the fixtures need not be as described, nor do they need to be relatively located as described. As to the first point, the spring loading could be substituted by fluid pressure or other appropriate biasing means. As to the second point, the fixture described as located uppermost could be the lowermost fixture, or the fixtures could be located side by side rather than one above the other.

Various alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. A snap fastener including, a male part and a female part, each said part being formed of plastics material and comprising an operative component and a securing component to be coupled together with a sheet material therebetween, each said operative component having a base wall with an opening therethrough and a tubular fastening portion surrounding said opening and projecting from one side of said base wall, the said tubular fastening portion of each said operative component being of complementary configuration so as to be snap engageable with the corresponding portion of the other said operative component, and the securing components beings substantially identical, each said securing component having a pin projecting axially from a cap flange at one end thereof, said pin being adapted to pass through the sheet material and through the opening of a said operative component so that a terminal end portion thereof is located beyond said one side of the base wall, and said terminal end portion being deformable when so located to secure the two said components against separation, wherein said terminal end portion is of a generally conical, pointed configuration so as to pierce said sheet material thereby avoiding the need for a preformed hole in the sheet material.

2. A snap fastener according to claim 1, wherein said tubular portion of the male part is a hollow cylindrical stud having a circumferential bead formed around the outer surface thereof at the end remote from the base wall, and the tubular portion of the female part is adapted to receive said stud within the interior thereof and has on its internal surface locking means which snap engages with said bead to resist axial separation of said male and female parts.

3. A snap fastener according to claim 2, wherein said locking means comprises a circumferential groove formed within said internal surface.

4. A snap fastener according to claim 2, wherein said locking means comprises a plurality of lip sections arranged circumferentially around said internal surface and each being snap engagable with said bead.

5. A snap fastener according to claim 4, wherein each said lip section has a region of maximum radial inward projection which is located substantially midway in the circumferential length thereof, and the extent of said projection progressively decreases on each side of said region.

6. A snap fastener according to claim 4, wherein said lip sections are circumferentially spaced apart.

7. A snap fastener according to claim 1, wherein a plurality of longitudinally extending grooves defining flutes are formed in said conical terminal end portion.

8. A snap fastener according to claim 1, wherein material gripping means is provided on opposed surfaces of said components.

9. A snap fastener according to claim 8 wherein said cap flange and said base wall are circular, and wherein said material gripping means comprise a lip provided around the periphery of said cap flange which projects away from the same side of the flange as does said pin, and a similar lip formed in a peripheral portion of said base wall and extending outwardly in a direction towards the lip of said cap flange.

10. A method of attaching a snap fastener part to a section of sheet material, said snap fastener part comprising an operative component and a securing component, both said components being formed of plastics material, said operative component having a base wall with an opening therethrough and tubular portion surrounding said opening and projecting from one side of said base wall, snap engaging means provided on said tubular portion, said securing component having a pin and a cap flange at one end thereof, said pin being adapted to pass through said opening so that a terminal end portion thereof is located beyon said one side of the base wall, and said terminal end portion being deformable when so located to secure the two said components against separation, and wherein at least a peripheral portion of said cap flange slopes outwardly in a direction towards the terminal end of said pin, said method including the steps of, causing said pin to pierce said sheet material, locating said operative component over said pin so that said sheet material is interposed between said cap flange and said base wall and said pin projects through said opening so that the terminal end portion thereof projects beyond said one side of the base wall, applying pressure to the terminal end of said pin to deform same to an extent such that said pin cannot be withdrawn out of said opening, applying axial pressure to both said components to press them together and thereby reduce or remove by deformation the said slope of said cap flange, and maintaining said axial pressure during said deformation of the pin terminal end.

* * * * *